US005881578A

United States Patent [19]

Proppe et al.

[11] Patent Number: 5,881,578

[45] Date of Patent: Mar. 16, 1999

[54] DRUM-TYPE WASHING MACHINE WITH A MULTI-PART FLUID LINE

[75] Inventors: Wolfgang Proppe; Christian Engel, both of Berlin; Andreas Stolze, Falkensee; Carsten Stelzer, Berlin; Gundula Czyzewski, Berlin, all of Germany

[73] Assignee: BSH Bosch und Siemens Hausgeraete GmbH, Munich, Germany

[21] Appl. No.: 993,484

[22] Filed: Dec. 18, 1997

[30] Foreign Application Priority Data

Dec. 18, 1996 [DE] Germany ..... 196 52 830.5

[51] Int. Cl.[6] ..... D06F 33/02

[52] U.S. Cl. ..... 68/12.02; 68/208

[58] Field of Search ..... 68/12.01, 12.02, 68/208

[56] References Cited

U.S. PATENT DOCUMENTS 5,048,139 9/1991 Matsumi et al. ..... 68/12.02 X

FOREIGN PATENT DOCUMENTS 0058576 8/1982 European Pat. Off. ..... 68/12.02

2127045 4/1984 United Kingdom ..... 68/12.01

*Primary Examiner*—Philip R. Coe

*Attorney, Agent, or Firm*—Herbert L. Lerner; Laurence A. Greenberg

[57] ABSTRACT

The fluid line between a drain opening at the bottom of the tub and an opening located at a higher level in the tub includes a line segment, which serves solely to keep the washwater in the tub in circulation between the upper opening and the drain opening. The line also has a solid pipe segment with a transparent region, at the wall of which a sensor is mounted that responds to the turbidity of the washwater. The sensor has an optical transmitter and an optical receiver. The sensor elements are built into a forked housing so as to securely mount and protect the sensor from the severe shaking during spin cycles. The forked housing embraces the pipe segment and the housing is adapted to the outer shape of the pipe segment at the faces which are in contact with the transparent region.

14 Claims, 3 Drawing Sheets

DRUM-TYPE WASHING MACHINE WITH A MULTI-PART FLUID LINE

BACKGROUND OF THE INVENTION

FIELD OF THE INVENTION

The invention pertains to a drum-type washing machine with a multi-part fluid line extending between a drain opening located at the bottom of the tub and an opening located in the tub geodetically above the drain opening; the fluid line includes a line segment that serves solely to keep the washwater in the tub in circulation between the upper opening and the drain opening, and which has a solid pipe segment with a transparent region; a sensor is attached at the wall that responds to the turbidity in the washwater and includes an optical transmitter and an optical receiver.

One such drum-type washing machine is known from German patent disclosure DE 36 03 323 A1. There, the sensor is installed so far downward toward the bottom in the washwater drainage system that water remaining in the washwater drainage system can lead to calcification of the transparent region and reduce its transparency. This has a tendency to render the measurement values picked up by the sensor incorrect. Moreover, the prior art turbidity sensor is subject to severe shaking during spin cycles, since the line segment is secured by one end to the vibrating tub and on the other to the stationary washwater pump. The tub vibrations are therefore transmitted to the sensor. Moreover, the fastening points of the line segment are as a result subject to very severe stresses.

SUMMARY OF THE INVENTION

It is accordingly an object of the invention to provide a drum washer with a multi-part fluid line, which overcomes the above-mentioned disadvantages of the heretofore-known devices and methods of this general type and which disposes an optical sensor for measuring the washwater turbidity such that neither the sensor nor the fastenings of the line segment is excessively stressed by shaking during spin cycles, and that the transparent region of the pipe segment does not become clouded by calcium deposits.

With the foregoing and other objects in view there is provided, in accordance with the invention, a drum-type washing machine, comprising:

- a tub having a bottom formed with a drain opening and an opening formed therein at a geodetically higher level than the drain opening;
- a drain line having an upper segment communicating with the drain opening for selectively draining the tub;
- a line segment with a first end connected to and communicating with the upper segment of the drain line and a second end connected to the opening disposed above the drain opening, the line segment being formed with a transparent region;
- a forked housing embracing the pipe segment and being adapted, at surfaces thereof which contact the transparent region, to an outer shape of the line segment; and
- a sensor for measuring a turbidity of washwater flowing through the line segment and past the transparent region, the sensor including an optical transmitter and an optical receiver mounted in the housing.

In accordance with an added feature of the invention, the line segment includes a solid pipe segment formed with the transparent region.

The above objects are thus satisfied in that the line segment is connected on one end to an upper part of the drain line and on the other end to the opening located higher up in the tub; the sensor is installed in a forked housing that embraces the pipe segment and is adapted, at its surfaces that contact the transparent region, to the outer shape of the pipe segment. In this way, the sensor comes to be located a region underneath the tub in which it is no longer exposed to the residue of washwater that always remains there. It is nevertheless, for the sake of measuring the turbidity in the washwater, fully exposed to the washwater during washing and/or rinsing. Moreover, jarring during spin cycles does no harm to the sensor or the fastenings of the line segment, because the line segment is coupled on both ends to connections that vibrate in the same direction as the tub.

For secure fastening of the sensor, the pipe segment, on its outer wall, has a podium base with a mounting face which faces away from the interior. The sensor, i.e., the sensor housing, is secured to the mounting face.

In accordance with an additional feature of the invention, the forked housing includes a first fork extension housing and infrared sensor (the optical transmitter), and a second fork extension housing a phototransistor (the optical receiver). There is also provided a connecting strip electrically contacting the infrared LED and the phototransistor inside the housing. In this way, the transmitter and the receiver have a position that is fixed once and for all and is then invariable relative to one another.

In accordance with another feature of the invention, the housing further includes a bridge for positioning the infrared LED and the phototransistor relative to one another, the bridge joining the first fork extension to the second fork extension and mounting the housing on the podium base.

In accordance with a further feature of the invention, the pipe segment communicates in fluid-tight fashion with the upper segment of the drain line, and including a flexible elbow connecting the pipe segment with the opening above the drain opening. The elbow may be formed of rubber-type material and with one of a plurality of creases.

The special embodiment of the line segment of the washing machine according to the invention is characterized in a fluid-tight communication with the upper part of the drain line connected to the drain opening and a communication, via a flexible elbow, with the upper opening in the tub. The elbow is preferably flexible, so that the line segment can be easily mounted during manufacture of the washing machine.

In accordance with again an added feature of the invention, the pipe segment forms an elbow and is connected to the opening of the tub. As a result, the sensor comes to be located in the highest possible position that is still exposed to washwater during washing machine operation.

In accordance with again another feature of the invention, the pipe segment is an integral component of the line segment. Further, the line segment includes a bellows-type multiple corrugation in addition to the pipe segment.

In accordance with again a further feature of the invention, the line segment includes a pipe communicating in fluid-tight fashion with the pipe segment at an end thereof remote from the opening, and the pipe communicates with the upper segment of the drain line. The pipe may be a corrugated pipe.

In accordance with a concomitant feature of the invention, the pipe segment is curved in a smooth and steady curve.

In other words, either the pipe segment may be an integral component of the line segment, or on its end remote from the opening, communicates in fluid-tight fashion by means of a pipe with the upper segment of the drain line connected to the drain opening. In the first case, the entire line segment may comprise a fixed pipe component, or this pipe component may have a multiple-part corrugation outside the pipe segment. In the second case, the pipe may either have a smooth wall or it may be a corrugated tube. In all of these alternatives, it is especially beneficial to the unhindered flow of the washwater which is to be measured when the pipe segment is steadily and smoothly curved.

Other features which are considered as characteristic for the invention are set forth in the appended claims.

Although the invention is illustrated and described herein as embodied in a drum-type washing machine with a multi-part fluid line, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
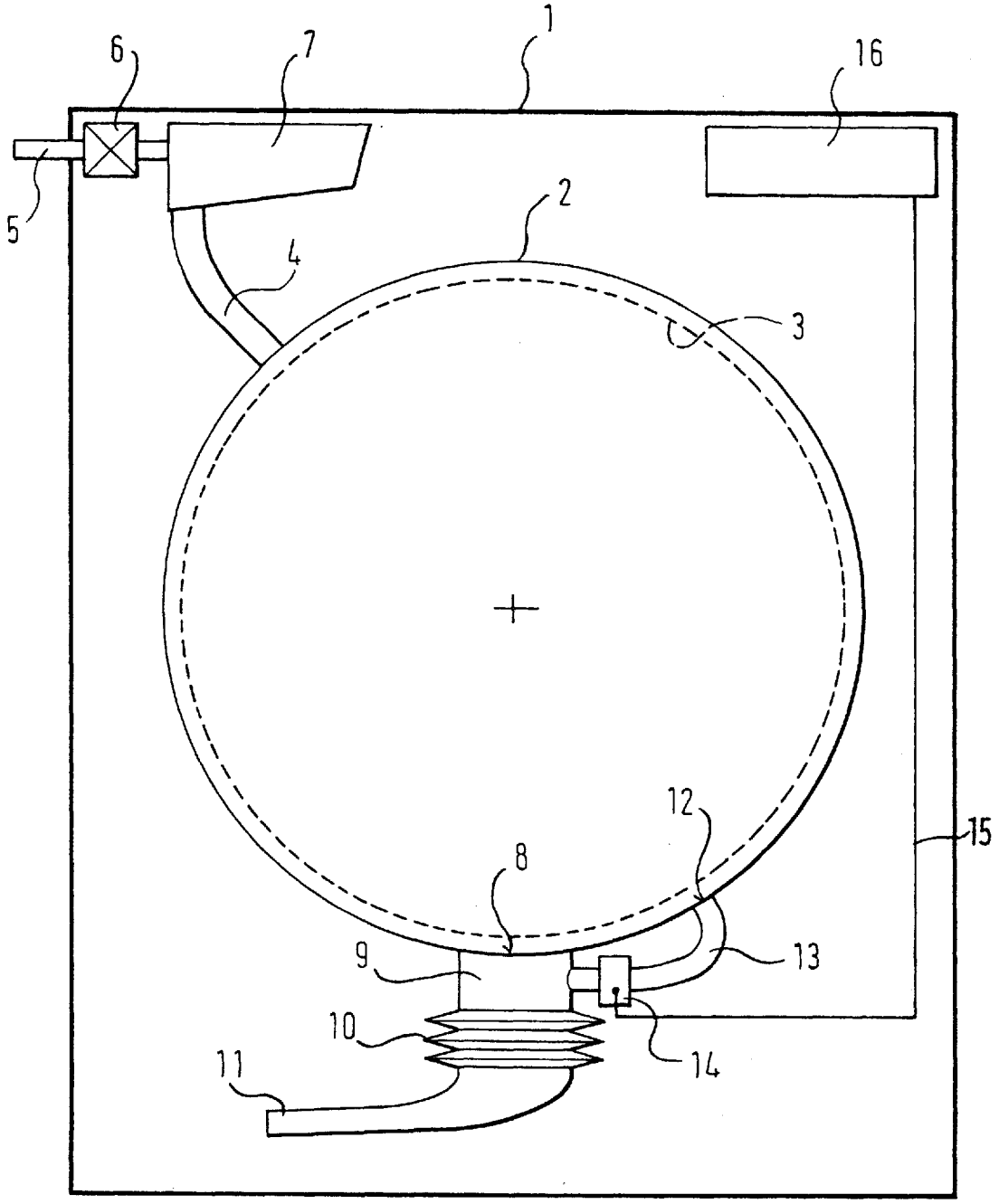
FIG. 1 is a schematic front view of a drum-type washing machine with the novel disposition of a sensor on a line segment.

The washing machine shown in FIG. 1 has a housing 1, in which a tub 2 (suds container) is mounted. While the specific details of the tub mounting are not illustrated, it is noted that the tub 2 is capable of vibrating. A laundry drum 3 is rotatably supported about a horizontal axis in the tub 2. Water and optionally detergent can be supplied to it in the upper portion of the tub 2 via a line 4 from a supply line 5 via a magnet valve 6 and a detergent dispenser 7. A drain line 9 communicates in fluid-tight fashion with a drain opening 8 in the lower portion of the tub 2. The drain line 9 communicates via bellows creases 10 and a further line 11, with a non-illustrated washwater pump fixedly mounted in the housing 1. Located between the drain line 9 and a further opening 12, which is disposed at a somewhat higher geodetic level than the drain opening 8, there is a line segment 13. Due to the level difference between the openings 8 and 12, there is a steady flow of washwater through the line segment 13 during washing machine operation. The flow is thereby into and through the opening 12 to the drain line 9 and back via the drain opening 8 into the tub 2. As noted, the flow is based on the slight pressure differences in the washwater above the drain opening 8 and the opening 12.

A sensor 14 is mounted on the line segment 13, and its output signals are output via a line 15 to a processing and control unit 16. The unit 16 processes the sensor signals.

Figure 2:
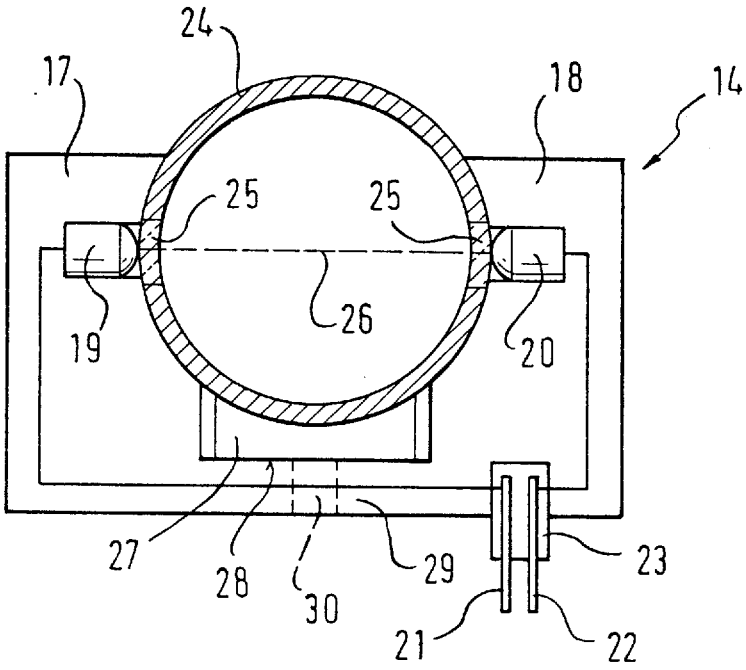
FIG. 2 is a sectional view of a pipe segment with the forked sensor housing embracing the pipe segment.

The sensor 14 shown in FIG. 2 is accommodated in a housing, in whose fork extensions 17 and 18 an infrared LED 19, as an optical transmitter, and a phototransistor 20, as an optical receiver, are respectively embedded. Their supply lines are likewise embedded in the housing and lead to terminals 21 and 22 of a connecting strip 23.

The pipe segment 24, shown in section, includes transparent regions 25, at least at the positions of the transmitter and the receiver (19 and 20), through which the transmitting beam 26 of the infrared LED 19 can pass. The pipe segment 24 has a podium base 27, on the lower portion of its outer wall, with a mounting face 28. The face 28 faces away from the interior of the pipe 24 and toward the bridge 29 of the sensor housing. It serves to secure the sensor 14, and for that reason a screw hole 30 is provided in the bridge 29.

Figure 3:
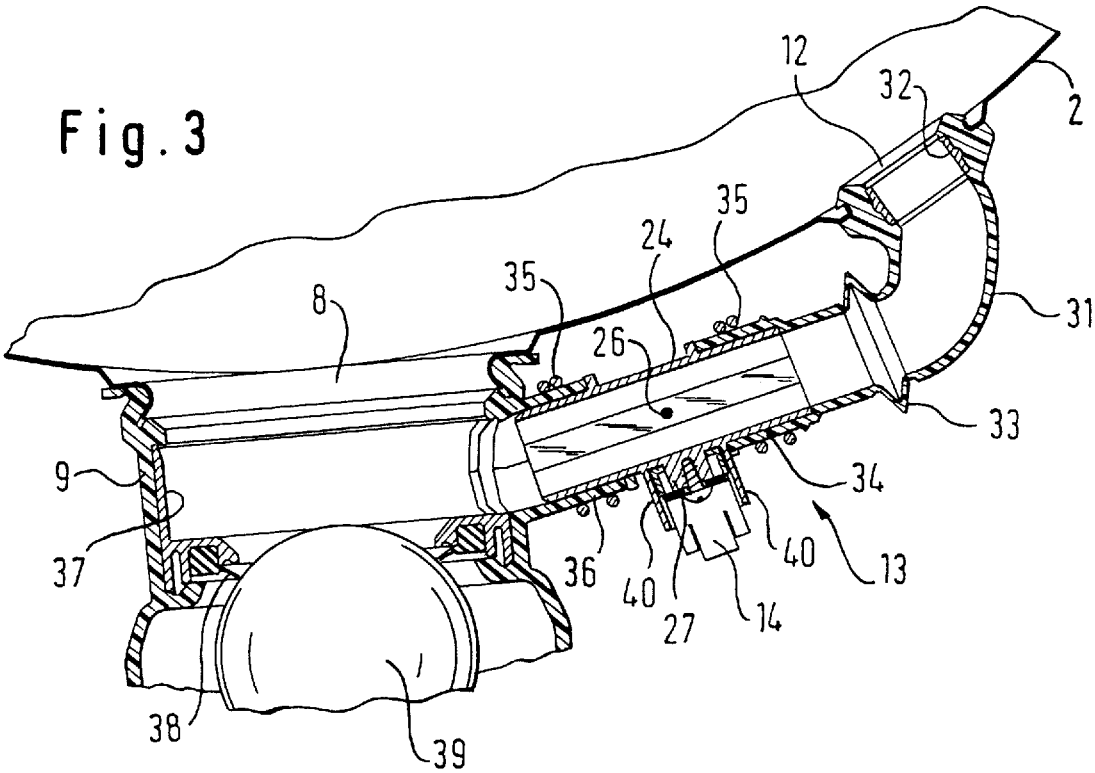
FIG. 3 is a partial, longitudinal sectional view taken through an embodiment of the line segment with a creased elbow made of rubber.

The line segment 13 in FIG. 3 comprises a flexible elbow 31, which is snapped at one end into the opening 12 of the tub 2. To secure this connection, a support sleeve 32 is also provided. To compensate for tolerances, the elbow 31 has a crease 33 and is equipped on the other end with a securing bush 34, which is slipped over one end of the pipe segment 24 and secured with a hose clamp 35. The other end of the pipe segment 24 is seated in a rubber bush 36 of the drain line 9 and is likewise secured by a hose clamp 35. The upper part 9 of the drain line is somewhat longer than it would be without the coupling to a line segment 13 and therefore has a support ring 37, which on its lower end has a sealing lip 38 that together with a ball 39 seals off the drain line. The sensor 14 is secured to the podium base 27 of the pipe segment 24 by means of a screw. Lateral walls 40 on the pipe segment 24 also contribute to secure positioning during assembly.

Figure 4:
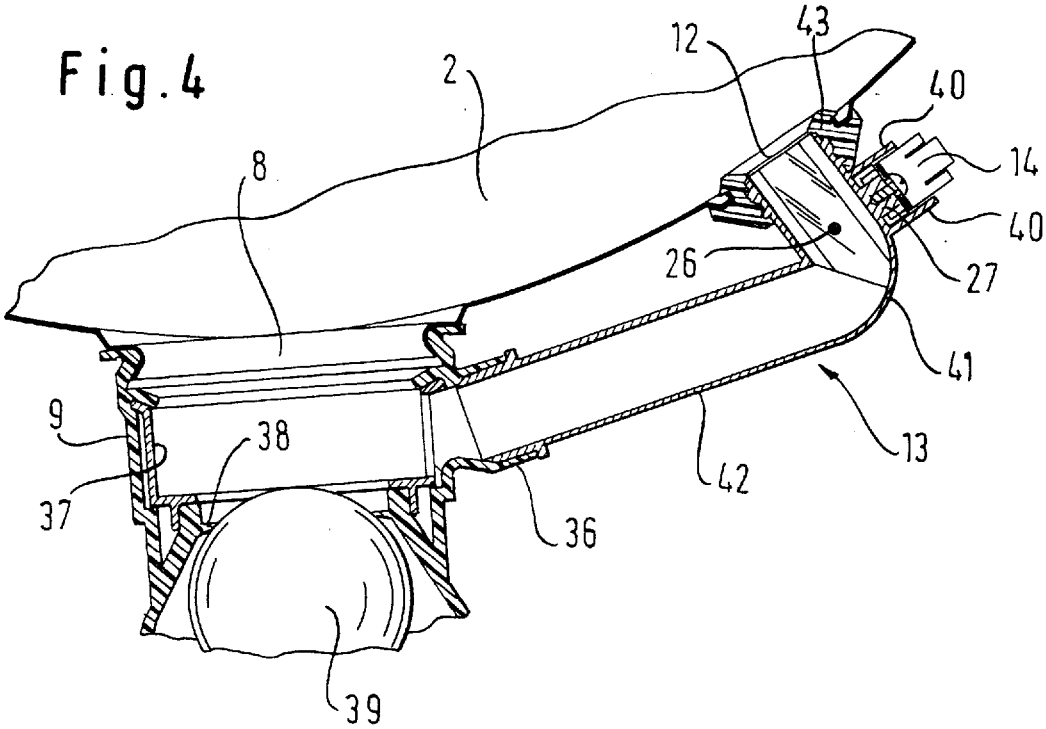
FIG. 4 is a similar view of a one-piece line segment with a solid pipe.

In a similar way, the sensor 14 in FIG. 4 is mounted on the pipe segment embodied as an elbow 41. The elbow has a sharp kink and is snapped into the opening 12 of the tub 2 by means of a rubber seal 43. It is an integral component of the line segment 13, which with its straight part 42 is inserted into a rubber bush 36 of the drain line 9. Due to the fact that the line segment 13 in FIG. 4 is an intrinsically rigid structure, it is unnecessary here to secure the rubber bush 36 with a hose clamp.

Figure 5:
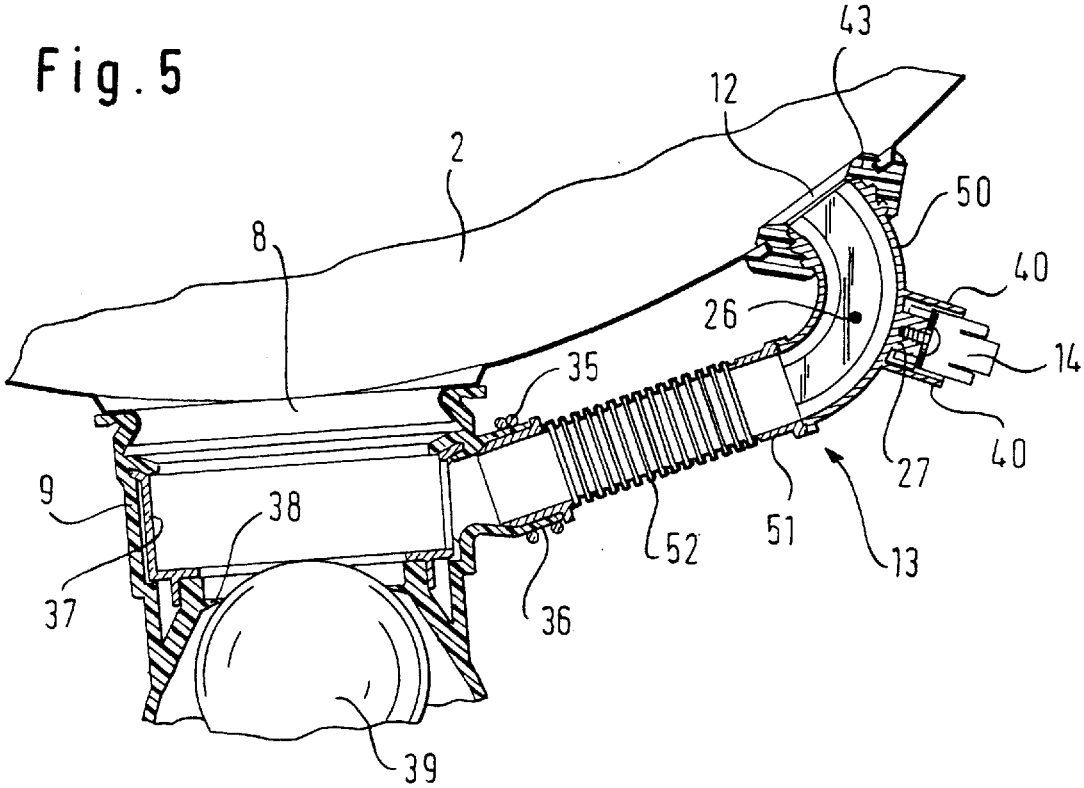
FIG. 5 is a similar view of a two-piece line segment with a corrugated pipe.

In the exemplary embodiment of the line segment 13 shown in FIG. 5 as well, the sensor 14 is secured to the pipe segment 50 similarly to the above embodiment. Here, however, the pipe segment is embodied as a steadily curved elbow 50, which has less flow resistance than the line kink of the elbow 41 in FIG. 4. The line segment 13, conversely, is embodied in two parts. Unlike what is shown, however, a one-part embodiment as in FIG. 4 is possible in this version as well. To that end, the line segment 13 would have to be embodied as a blow-molded part. The second part of the line segment 13 is a corrugated pipe 51, whose corrugations 52 can serve merely to compensate for tolerances. However, it has been demonstrated that tolerance compensation already occurs in an adequate way as a result of the rubber parts of the snap-in seal 43 and the rubber bush 36. In a two-part embodiment of the line segment 13, a hose clamp 35 is again necessary on the rubber bush 36.

It will be appreciated that the components of the line segment that are shown in the exemplary embodiments of FIGS. 3–5 can be combined with one another arbitrarily, depending on the demands of any given application. It is also possible to vary the embodiment of the housing 17, 18 and 29 of the sensor 14 in FIG. 2 in any way, as long as the disposition of the transmitter 19 and the receiver 20 is retained.

We claim:

1. A drum-type washing machine, comprising:

a tub having a bottom formed with a drain opening and an opening formed therein at a geodetically higher level than said drain opening;

a drain line having an upper segment communicating with said drain opening for selectively draining said tub;

a line segment with a first end connected to and communicating with said upper segment of said drain line and a second end connected to said opening disposed above said drain opening, said line segment being formed with a transparent region;

a forked housing embracing said pipe segment and being adapted, at surfaces thereof which contact said transparent region, to an outer shape of said line segment; and a sensor for measuring a turbidity of washwater flowing through said line segment and past said transparent region, said sensor including an optical transmitter and an optical receiver mounted in said housing.

2. The washing machine according to claim 1, wherein said line segment includes a solid pipe segment formed with said transparent region.

3. The washing machine according to claim 2, wherein said pipe segment communicates in fluid-tight fashion with said upper segment of said drain line, and including a flexible elbow connecting said pipe segment with said opening above said drain opening.

4. The washing machine according to claim 3, wherein said elbow is formed of rubber-type material and is formed with a crease.

5. The washing machine according to claim 4, wherein said crease is one of a plurality of creases.

6. The washing machine according to claim 2, wherein said pipe segment has an elbow connected to said opening above said drain opening.

7. The washing machine according to claim 6, wherein said pipe segment is an integral component of said line segment.

8. The washing machine according to claim 6, wherein said line segment includes said pipe segment and a bellows-type multiple corrugation.

9. The washing machine according to claim 6, wherein said line segment includes a pipe communicating in fluid-tight fashion with said pipe segment at an end thereof remote from said opening, and said pipe communicates with said upper segment of said drain line.

10. The washing machine according to claim 9, wherein said pipe is a corrugated pipe.

11. The washing machine according to claim 2, wherein said pipe segment is curved along a steady curve.

12. The washing machine according to claim 1, which further comprises a podium base formed on an outer wall of said pipe segment, said podium base having a mounting face facing away from said pipe segment to which said sensor is secured.

13. The washing machine according to claim 1, wherein said forked housing includes a first fork extension housing said optical transmitter in the form of an infrared LED, and a second fork extension housing said optical receiver in the form of a phototransistor, and including a connecting strip electrically contacting said infrared LED and said phototransistor inside said housing.

14. The washing machine according to claim 13, wherein said housing further includes a bridge for positioning said infrared LED and said phototransistor relative to one another, said bridge joining said first fork extension to said second fork extension and mounting said housing on said podium base.

* * * * *